US006042891A

United States Patent [19]

Crossingham et al.

[11] Patent Number: 6,042,891

[45] Date of Patent: Mar. 28, 2000

[54] ROLL FORMING STRUCTURAL STEEL PROFILES WITH GALVANISED COATING

[75] Inventors: Brian Roy Crossingham, Eleebana; Andrew Robert Dickson, Raymond Terrace; Rodney Matthew Langford, Lakelands; Douglas Ian Moore, Beresfield; Darrell St Clair Townsend, Eleebana, all of Australia

[73] Assignee: Tubemakers of Australia Limited, Sydney, Australia

[21] Appl. No.: 08/981,973

[22] PCT Filed: Jul. 9, 1996

[86] PCT No.: PCT/AU96/00431

§ 371 Date: Jan. 9, 1998

§ 102(e) Date: Jan. 9, 1998

[87] PCT Pub. No.: WO97/03218

PCT Pub. Date: Jan. 30, 1997

[30] Foreign Application Priority Data

Jul. 11, 1995 [AU] Australia ..... PN4109

[51] Int. Cl.[7] ..... B05D 1/18; B05D 3/12; B21B 1/46

[52] U.S. Cl. ..... 427/433; 427/329; 427/328; 427/398.1; 427/367; 427/436; 29/527.4; 72/47; 72/365.2

[58] Field of Search ..... 427/329, 328, 427/398.1, 433, 436, 367; 72/47, 365.2; 148/658, 661; 29/DIG. 3, DIG. 36, 527.4

[56] References Cited

U.S. PATENT DOCUMENTS

| | | | |
|---|---|---|---|
| 3,607,366 | 9/1971 | Kurokawa | 117/102 M |
| 3,696,503 | 10/1972 | Krengel et al. | 29/527.4 |
| 4,123,261 | 10/1978 | Moren et al. | 75/125 |
| 4,237,154 | 12/1980 | Garrison | 427/241 |
| 4,358,887 | 11/1982 | Creps | 29/527.4 |
| 4,533,606 | 8/1985 | Teng et al. | 428/658 |
| 5,666,714 | 9/1997 | Height et al. | 29/527.4 |

FOREIGN PATENT DOCUMENTS

| | | |
|---|---|---|
| 71834/91 | 8/1991 | Australia . |
| 05311371 | 11/1993 | Japan . |
| 287201 | 3/1928 | United Kingdom . |

*Primary Examiner*—Shrive Beck
*Assistant Examiner*—Michael Barr
*Attorney, Agent, or Firm*—Ostrolenk, Faber, Gerb & Soffen, LLP

[57] ABSTRACT

Structural steel profiles such as channels, having a material thickness greater than 2 mm, are roll-formed to a preform profile with corners partial bent, in-line galvanized, and then further roll-formed to final shape. The preform profile has upwardly facing convex surfaces allowing rapid shedding of excess galvanising material. By preforming corners before galvanising, surface elongation in the galvanising layer is minimized and cracking eliminated. This is enhances by constant length bending of corners over preform and final roll-forming operations.

7 Claims, 3 Drawing Sheets

ROLL FORMING STRUCTURAL STEEL PROFILES WITH GALVANISED COATING

TECHNICAL FIELD

This invention relates to roll forming structural steel profiles with galvanised coating and has been devised particularly though not solely for roll forming profiles from hot rolled steel strip.

BACKGROUND ART

It is well known to provide in-line galvanising of steel sections such as round tube where the section is formed to substantially the desired shape and then passed through an in-line galvanising bath or trough to provide the coating of galvanising material which is typically zinc. This works well for most closed sections but problems are encountered with some open profile shapes, such as channels, in obtaining an even coating of galvanising material after the bath due to the difficulty in quickly blowing excess material from various areas of the section.

It has also been known to form open structural profiles of galvanised steel by taking pre-galvanised flat steel strip and roll forming that strip to the desired profile, e.g. angle or channel sections by a conventional roll forming process. The bending of the flat strip in the roll forming process does however impose significant elongations of the outer surface of each corner formed when the strip is thick enough to form a structural profile. (Throughout this specification the term "structural profile" is taken to refer to profiles formed from strip having a thickness generally greater than 2 mm.) To deal with this situation, the industry standard has been to use a zinc coating where the galvanising material incorporates alloys such as aluminium and where the base metal strip to which the galvanised coating has been applied is formed either by the cold rolling process or by hot rolled, pickled and oiled. The combination of the cold rolled steel base layer and significant percentages of alloy in the zinc coating when correctly applied according to known processes results in a thin and ductile galvanising layer on the base metal which can withstand the significant elongation required in the bending of corners during the roll forming of the structural profile.

However there are instances in the manufacturing process where the zinc coating may not always be correctly applied according to the most desirable parameters and in such cases less ductile coatings than desired result which in some instances can crack through significant elongation of the outer surface during the roll forming process. This problem may also exist where the strip has been galvanised in simpler galvanising operations which do not use aluminium alloys or where the parent material has a surface which can be regarded as highly reactive to the galvanising process (such as shot blasted strip).

When using both cold rolled and hot rolled base material it is desirable to provide a method of forming a structural section where some allowance can be made for less than ideal zinc coating parameters so that forming of the material to the desired shape after galvanising has taken place does not result in unacceptable levels of cracking in the zinc layer.

SUMMARY OF THE INVENTION

The present invention therefore provides a method of manufacturing a continuous length of steel having a structural profile incorporating at least one corner of predetermined included angle and a coating of galvanising material. The method includes the steps of:

roll forming a steel strip to a preformed profile wherein said corner is partially bent to an included angle significantly greater than the predetermined included angle, applying the coating of galvanising material by passing the preformed profile through an inline galvanising stage, rapidly quenching the profile exiting from the in-line galvanising stage, and further roll forming the profile to the desired structural profile.

In one form of the invention the steel strip comprises hot rolled steel strip.

Preferably the hot rolled steel strip is shot blasted to clean its surfaces prior to galvanising.

Preferably the steps of forming the corner in the preformed profile and further roll forming to conform the corner to the predetermined included angle together comprise constant length bending of the corner.

Preferably the preformed profile is configured such that the or each corner is partially bent to an included angle sufficiently similar to the corresponding predetermined included angle that the further roll forming of the profile to the desired structural profile does not cause significant elongation in the coating of galvanising material.

BRIEF DESCRIPTION OF THE DRAWINGS

Notwithstanding any other forms that may fall within its scope one preferred form of the invention will now be described by way of example only with reference to the accompanying drawings in which.

MODES FOR CARRYING OUT THE INVENTION

Figure 1:
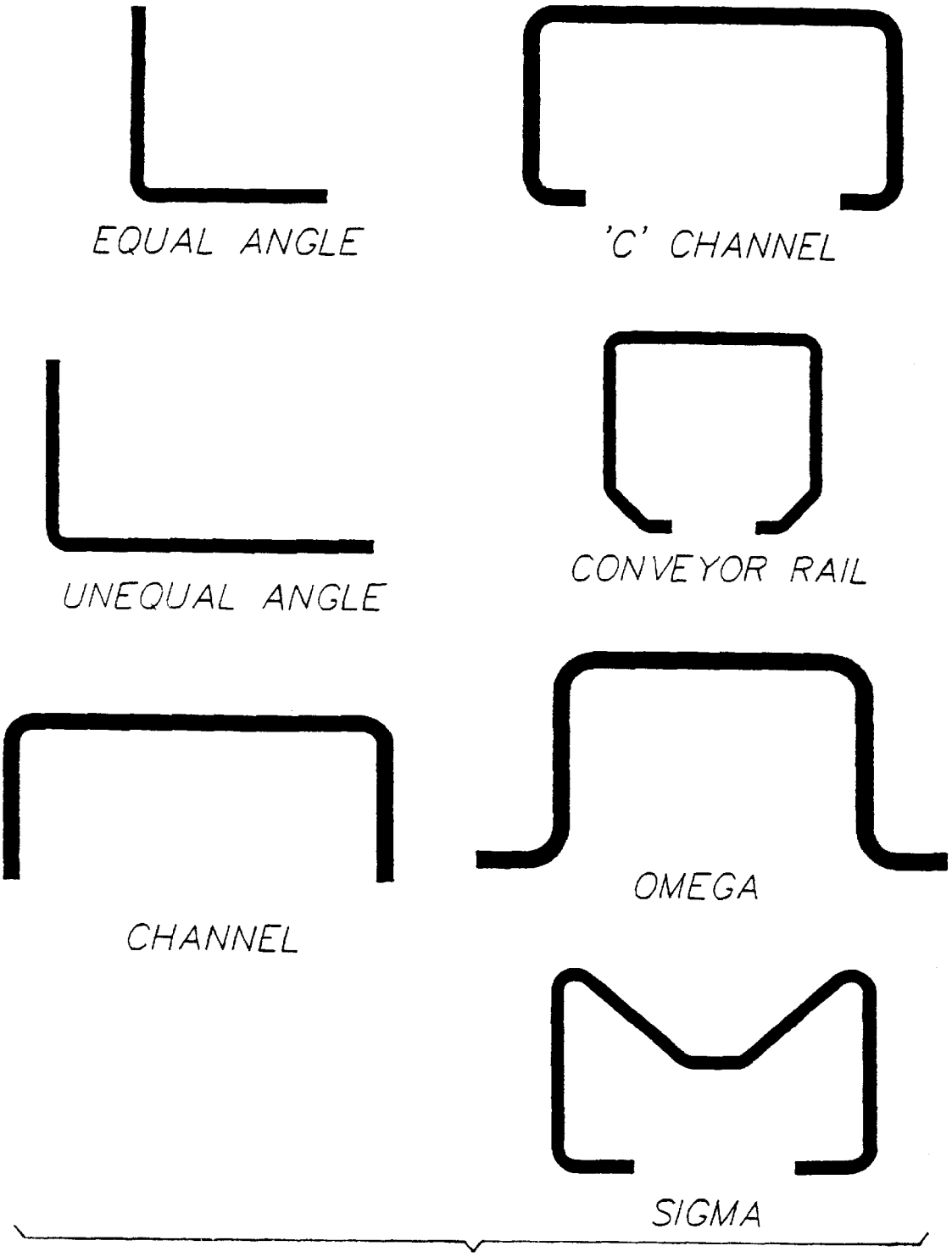
FIG. 1 shows a number of typical profiles able to be manufactured by the method according to the present invention.

In the preferred form of the invention so-called "open profiles" are roll formed to any desired shape incorporating at least one corner of predetermined included angle. Such included angle is typically a 90° angle and typical profiles formed according to this method are shown in FIG. 1. As can be seen from the examples given a number of different profiles can be formed all having at least one corner of 90° and some with additional corners of greater than 90° or, in the case of the Sigma profile, corners of less than 90° included angle.

The method of forming such profiles, and others, according to the invention is similar but will be described specifically with regard to the equal angle profile and the channel profile.

Figure 2:
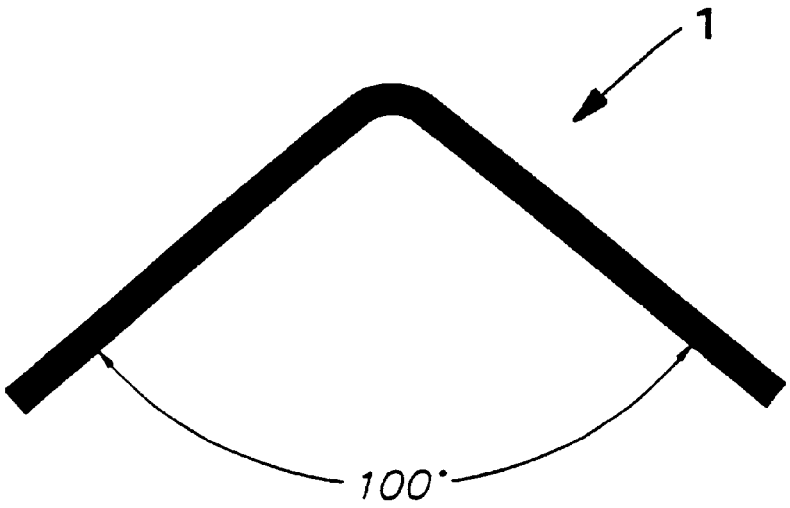
FIG. 2 shows the preformed profile of an intended angle section.

FIG. 2 shows the preformed profile 1 of an equal angle section where the base steel strip has been bent to a corner having an included angle of 100° before galvanising by an in-line process.

Figure 3:
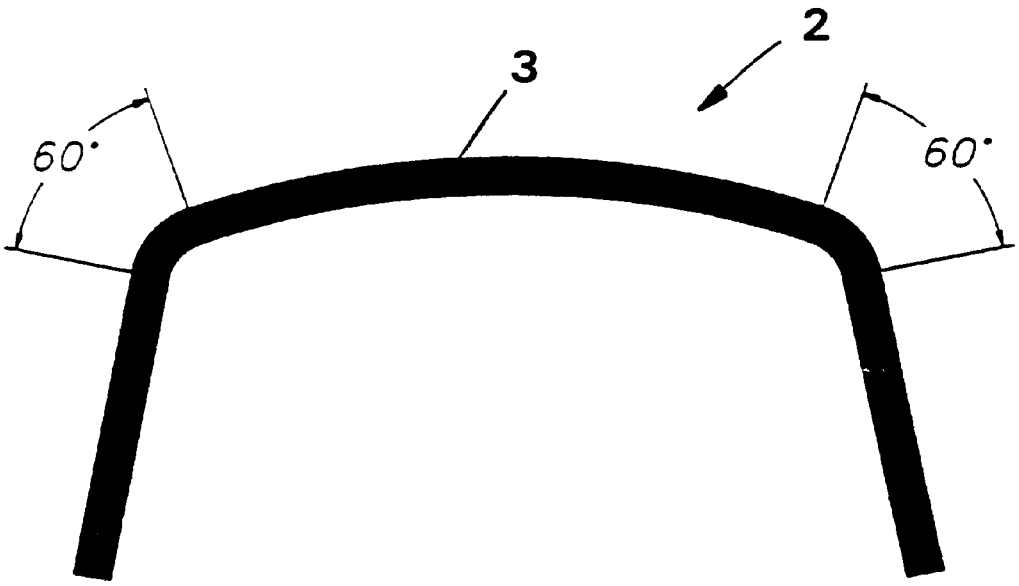
FIG. 3 shows the preformed profile of an intended channel section.

Similarly in FIG. 3 there is shown the section of a preformed channel 2 where the two corners of the channel have been preformed by bending through an angle of 60°, i.e. to form an included angle of approximately 120° before the galvanising process. The web section 3 of the channel has also been formed to an upwardly facing convex configuration prior to the in-line galvanising process.

In each case the corner, or corners of the section is partially bent to an included angle significantly greater than the desired included angle in the final profile shape. In the case of the equal angle section as shown in FIG. 2, the included angle of the preformed profile is 100°, being significantly greater than the 90° final included angle in the equal angle section. Similarly the included angle for each corner of the channel section is 120° in the preformed section being significantly greater than the 90° of the finally shaped channel section. The change in included angle between the preformed profile and the final section is therefore significant, and much greater than the few degrees of change which might take place by roll forming in re-shaping to eliminate distortions which might have occurred in batch hot dip galvanising of net or near net shaped black profiles.

By roll forming the steel strip to the preformed profiles described before galvanising, the amount of deformation required to complete the formation of the desired profile after galvanising is significantly limited and the amount of elongation required on the outside surface of any particular corner is therefore restricted. By restricting the elongation on the outer surface of the corner, the integrity of the galvanising layer can be maintained.

It is also a feature of the invention that the forming to the shapes shown prior to galvanising permits the preformed profile to be designed for ease of shedding surplus galvanising material from the profile either by air rings or by a wiping process. Typically the preformed profiles at the galvanising stage can be designed to not include any flat horizontal surfaces which would result in undesirable pooling or puddling of the galvanising layer which should be kept as thin and consistent as possible both for economic reasons and to reduce the possibility of cracking during final roll forming to the desired ultimate profile.

Figure 4:
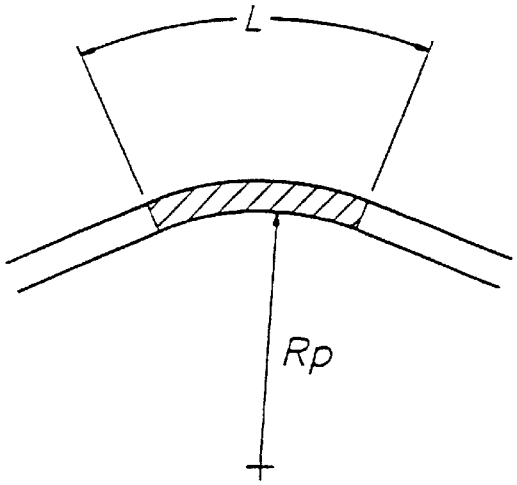
FIG. 4 is a partial section through a partially formed corner being bent according to the constant length method.

It is also preferred to roll form each corner of the profile by the "constant length" method rather than the "constant radius" method. This can be explained with reference to FIGS. 4 to 7 in which FIGS. 4 and 5 show the constant length method of forming a bend in two stages, before and after the galvanising operation and similarly FIGS. 6 and 7 show the two phases in forming a corner according to the constant radius method.

Figure 5:
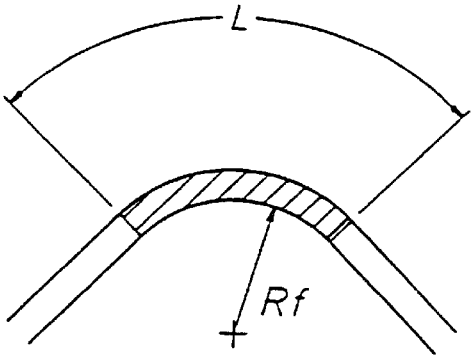
FIG. 5 is a similar view showing the completed corner.
Figure 7:
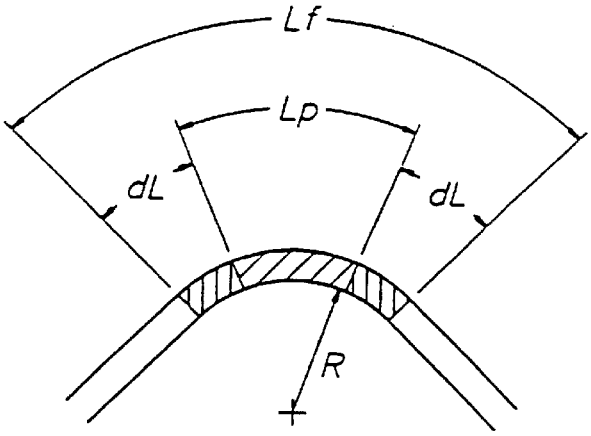
FIG. 7 is a similar view of the completed corner.

Although the corner or bend shown in FIGS. 5 and 7 is the same in the ultimate profile, the method of bending results in different degrees of elongation of the metal on the outer surface of the bend. In constant length forming the steel is bent to a first internal radius Rp over a length of metal L. After galvanising the corner is bent to the desired degree by tightening the bend over the same length L to a tighter internal radius Rf.

Figure 6:
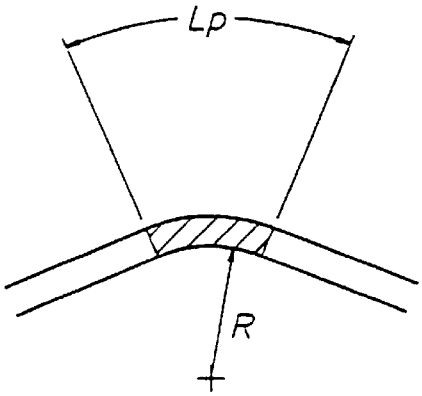
FIG. 6 is a partial cross-section through a partially formed corner being bent according to the constant radius method.

By way of contrast using the constant radius method of forming the bend, the preformed profile bend is first formed to radius R over length Lp as shown in FIG. 6. After galvanising the bend is further developed over the two outer sections by bending a further length dL on either side of the initial length Lp to give a total bend length Lf over the same original radius R.

Using the constant radius method the outer surface of the metal over the length of the bend Lp will not require any further elongation after the galvanising process but the outer surface over the lengths dL will require significant elongation leading to potential cracking in the galvanising layer.

By way of contrast the constant length method of bending shown in FIGS. 4 and 5 will require an even elongation of the outer surface of the metal strip in the post galvanising bending but this degree of elongation will be significantly less than the elongation over the lengths dL in the configuration shown in FIG. 7.

In order to keep the overall amount of elongation required in the galvanising layer to a minimum and therefore reduce the chance of cracking it is desirable to combine the bending operations previously described with reference to FIGS. 2 and 3, with the constant length method of bending.

Using the combination of bending to a preformed profile before galvanising and the constant length method of bending it has been found that it is possible to reduce the elongation on the outer surface of the steel and therefore in the outer galvanising layer by a significant amount and so avoid cracking in the coating of galvanising material on the outside of corners.

We claim:

1. A method of manufacturing a continuous length of steel having a structural profile incorporating at least one corner of predetermined included angle and a coating of galvanising material, said method comprising the steps of:

roll forming a steel strip to a preformed profile wherein said corner is partially bent to an included angle significantly greater than said predetermined included angle, said included angle being sufficiently similar to said predetermined included angle that further roll forming to said desired structural profile does not cause significant elongation in said coating of galvanising material;

applying said coating of galvanising material by passing said preformed profile through an in-line galvanising stage;

quenching the profile exiting from the in-line galvanising stage; and further roll forming the profile to the desired structural profile with the corner at the predetermined included angle.

2. A method as claimed in claim 1 wherein the steel strip comprises hot rolled steel strip.

3. A method as claimed in claim 2 wherein the hot rolled steel strip is shot blasted to clean its surfaces prior to galvanising.

4. A method as claimed in claim 1 wherein the steps of forming the corner in the preformed profile and further roll forming to conform the corner to the predetermined included angle together comprise constant length bending of the corner.

5. A method as claimed in claim 1 wherein the preformed profile is configured such that the difference between the included angle of the corner in the preformed profile and the corresponding predetermined included angle of the finished profile is sufficiently low to avoid cracking in the coating of galvanising material on the outside of said corner during said further roll forming of the profile to the desired structural profile.

6. A method as claimed in claim 1, wherein the preformed profile is configured for ease of shedding surplus galvanising material from the profile after passing through the in-line galvanising stage.

7. A method as claimed in claim 6, wherein the preformed profile is configured to eliminate any flat horizontal surfaces.

* * * * *